US005616966A

United States Patent [19]

Fischer et al.

[11] Patent Number: 5,616,966

[45] Date of Patent: Apr. 1, 1997

[54] ANTI-THEFT SYSTEM FOR A MOTOR VEHICLE

[75] Inventors: Armin Fischer, Nuremberg; Stefan Haimerl, Leonberg; Manfred Glehr, Neutraubling, all of Germany

[73] Assignee: Siemens Aktiengesellschaft, Munich, Germany

[21] Appl. No.: 554,821

[22] Filed: Nov. 7, 1995

[30] Foreign Application Priority Data

Nov. 7, 1994 [EP] European Pat. Off. ..... 94117526

[51] Int. Cl.[6] ..... E05B 47/00

[52] U.S. Cl. ..... 307/10.5; 307/10.3; 307/10.4; 180/28.7; 70/DIG. 46; 340/426

[58] Field of Search ..... 307/9.1–10.8; 180/287; 361/171, 172; 340/425.5, 426, 825.72, 825.69, 825.3, 825.34, 825.7; 364/424.01–424.05; 123/198 B, 198 DB, 198 DC; 70/277, DIG. 46

[56] References Cited

U.S. PATENT DOCUMENTS

| | | | |
|---|---|---|---|
| 4,738,334 | 4/1988 | Weishaupt | 307/10.5 |
| 4,918,955 | 4/1990 | Kimura et al. | 70/277 |
| 5,117,097 | 5/1992 | Kimura | 70/278 |
| 5,280,267 | 1/1994 | Reggiani | 340/426 |
| 5,307,658 | 5/1994 | Kokubu | 70/276 |
| 5,552,789 | 9/1996 | Schuermann | 340/825.31 |

FOREIGN PATENT DOCUMENTS

| | | |
|---|---|---|
| 0151087 | 8/1985 | European Pat. Off. . |
| 2518285 | 6/1983 | France . |
| 2152311 | 7/1985 | United Kingdom . |

*Primary Examiner*—Jonathan Wysocki
*Assistant Examiner*—Peter Ganjoo
*Attorney, Agent, or Firm*—Herbert L. Lerner; Laurence A. Greenberg

[57] ABSTRACT

An anti-theft system for a motor vehicle includes a portable transponder carrying code information. A stationary transceiver has an oscillator and an oscillating circuit being excited to oscillate by the oscillator at an oscillation being modulated by the transponder in synchronism with the code information. A demodulator demodulates the modulated oscillation of the oscillating circuit. According to one embodiment, the code information is obtained from the demodulated oscillation by sampling the oscillation at least at one predetermined sampling time. An arithmetic unit compares the code information with command code information and transmits an enable signal to a security unit if a match occurs. The modulated oscillation being shifted by a predetermined phase angle is sampled once again if initially no code information is recognized from the demodulator. According to another embodiment, the modulated oscillation containing the code information is sampled at least at two predetermined times being phase-shifted from one another by a predetermined phase angle and the code information is obtained from voltage values detected at the sampling times. The arithmetic unit compares the code information with the command code information and transmits an enable signal to a security unit if a match occurs.

7 Claims, 5 Drawing Sheets

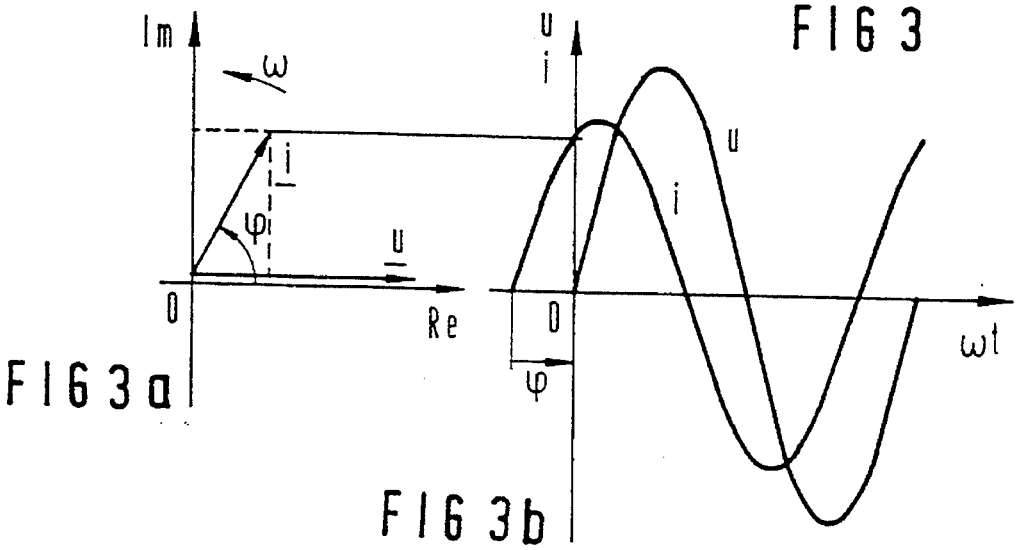
FIG 3
FIG 3a
FIG 3b
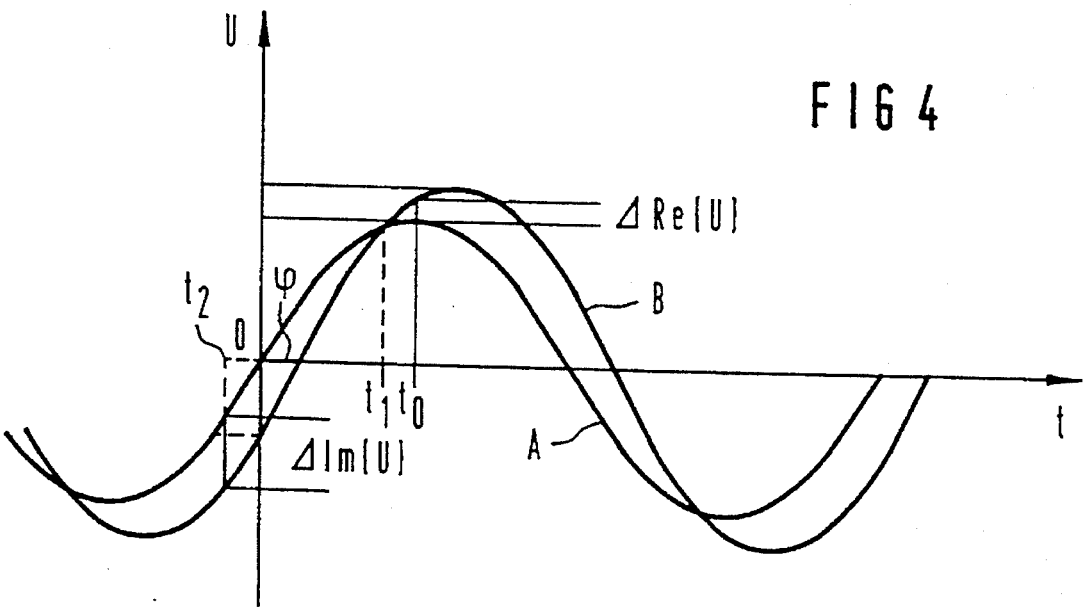
FIG 4

37
μP.
35
36
34
32,33
1
31
R14
C9
GND
U3B
C6
U1A
A
B
C
U3A
R12
VCC
R11
R13
C7
L1
C14
R17
R18
R3
U2A
C2
R4
R5
U2C
R6
C15
R9
C4
R7
C10
U2B
C5
C3
R1
R2

ANTI-THEFT SYSTEM FOR A MOTOR VEHICLE

BACKGROUND OF THE INVENTION

Field of the Invention

The invention relates to an anti-theft system for a motor vehicle. In particular, it relates to a locking system for doors of a motor vehicle and to a driveaway interlock, which enables starting of the engine when authorization exists.

A known anti-theft system (U.S. Pat. No. 4,918,955) has an ignition lock with a transmitter antenna in the form of a coil. The coil is excited by an oscillator. The ignition lock has an oscillating circuit that cooperates with the transmitter coil. As soon as the ignition key is introduced into the ignition lock, coded information is transmitted from the ignition key to the lock. If the coded information matches command code information, then a driveaway interlock in the motor vehicle is unlocked, so that the vehicle can be started.

In such systems, however, it is possible for no code information to be recognized by a receiver circuit, despite a properly inserted and properly functioning ignition key. That is because an operating point of the system may shift so far that it is in what is called a zero point, due to component tolerances or the effects of temperature.

SUMMARY OF THE INVENTION

It is accordingly an object of the invention to provide an anti-theft system for a motor vehicle, which overcomes the hereinafore-mentioned disadvantages of the heretofore-known devices of this general type and with which reliable actuation of doors or starting of the motor vehicle is possible despite component tolerances and effects of temperature.

With the foregoing and other objects in view there is provided, in accordance with the invention, an anti-theft system for a motor vehicle, comprising a portable transponder carrying code information; a stationary transceiver having an oscillator and an oscillating circuit being excited to oscillate by the oscillator at an oscillation being modulated by the transponder in synchronism with the code information; a demodulator connected to the transceiver for demodulating the modulated oscillation of the oscillating circuit; a sampling device connected to the demodulator for sampling the oscillation at least at one predetermined sampling time to obtain the code information from the demodulated oscillation; an arithmetic unit connected to the transceiver and to the sampling device for comparing the code information with command code information and issuing an enable signal if a match occurs; and a security unit connected to the arithmetic unit for receiving the enable signal; the sampling device once again sampling the modulated oscillation being shifted by a predetermined phase angle, if initially no code information is recognized from the demodulator.

A stationary transmitter in a lock has an oscillating circuit that is coupled with an oscillating circuit of a portable transponder in a key. In the transmitter, an oscillation is compelled which has energy that is transmitted to the transponder that in turn transmits coded data back to the transmitter. The code information of the transponder modulates the oscillation of the transmitter oscillating circuit in terms of its amplitude. A demodulator obtains the code information from the modulated oscillation and compares it with command code information, and if they match an enable signal is generated.

If success is not achieved initially when an attempt is made to detect the code information, then the modulated oscillation is sampled once again. The sampling time is shifted by a predetermined phase angle, as compared with the sampling time upon first detection of the code signal.

In accordance with another feature of the invention, the predetermined phase angle is 90°.

In accordance with a further feature of the invention, the oscillating circuit has a transmitter coil, and there is provided a transponder coil inductively coupling the transponder to the transmitter coil.

In accordance with an added feature of the invention, the oscillation of the oscillating circuit is load-modulated as a function of the code information due to the inductive coupling.

In accordance with an additional feature of the invention, the security unit is a door lock or a driveaway interlock.

With the objects of the invention in view, there is also provided an anti-theft system for a motor vehicle, comprising a portable transponder carrying code information; a stationary transceiver having an oscillator and an oscillating circuit being excited to oscillate by the oscillator at an oscillation being modulated by the transponder in synchronism with the code information; a demodulator connected to the transceiver for demodulating the modulated oscillation of the oscillating circuit; a sampling device connected to the demodulator for sampling the modulated oscillation containing the code information at least at two predetermined times being phase-shifted from one another by a predetermined phase angle and obtaining the code information from voltage values detected at the sampling times; an arithmetic unit connected to the transceiver and to the sampling device for comparing the code information with command code information and issuing an enable signal if a match occurs; and a security unit receiving the enable signal.

Other features which are considered as characteristic for the invention are set forth in the appended claims.

Although the invention is illustrated and described herein as embodied in an anti-theft system for a motor vehicle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 3*a* and 3*b* show a sinusoidal signal diagram and a pointer diagram thereof in a complex plane;

FIG. 4 is a diagram showing two periods of a modulated oscillation;

DESCRIPTION OF THE PREFERRED EMBODIMENTS

Figure 1:
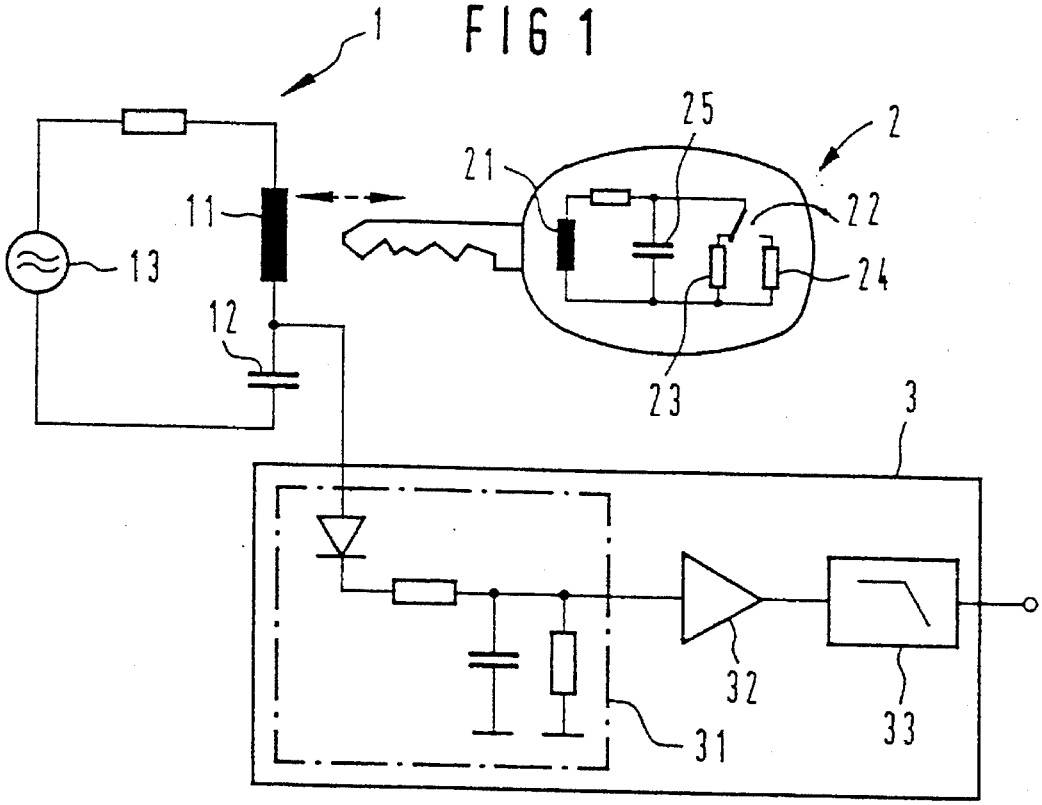
FIG. 1 is a schematic and block circuit diagram of an anti-theft system according to the invention.

Referring now to the figures of the drawing in detail and first, particularly, to FIG. 1 thereof, there is seen an anti-theft system according to the invention which has a stationary transceiver 1 in a lock, that cooperates with a portable transponder 2 in an ignition or door key through a transformational coupling when the transponder 2 is located in the vicinity of the transceiver 1. The transceiver 1 transmits energy to the transponder 2 (for this reason, the transceiver will be referred to below as the transmitter 1). Code information stored in the transponder 2 is transmitted back to the transmitter 1 (energy transmission and data transmission back again are represented by a double arrow shown in dashed lines).

In order to provide for energy and data transmission, the transmitter 1 has a transmitter coil 11 which, by way of example, is wound around the ignition lock or door lock. The transmitter coil 11 together with a transmitter capacitor 12 forms a transmitter oscillating circuit. The transmitter oscillating circuit is supplied by a generator or an oscillator 13 with an alternating voltage or an alternating current in synchronism or cadence with its oscillator frequency $f_O$ and is stimulated to oscillation. A field excited by the transmitter coil 11 induces a voltage in a transponder coil 21, if this coil is inductively coupled to the transmitter coil 11. This is the case whenever the key is introduced into the lock, for instance.

The transponder 2 has a load switch 22, which switches back and forth between two different load resistors 23 and 24 in in synchronism, phase or cycle with the predetermined code information stored in memory in the transponder 2. Since the two coils 11 and 21 are inductively coupled together (approximately like the primary and secondary coils of a transformer), the transmitter oscillating circuit is loaded by the transponder oscillating circuit in the rhythm of the code information. The code information is consequently transmitted to the transmitter 1. There it is detected and evaluated by an evaluation unit 3.

Figure 7:
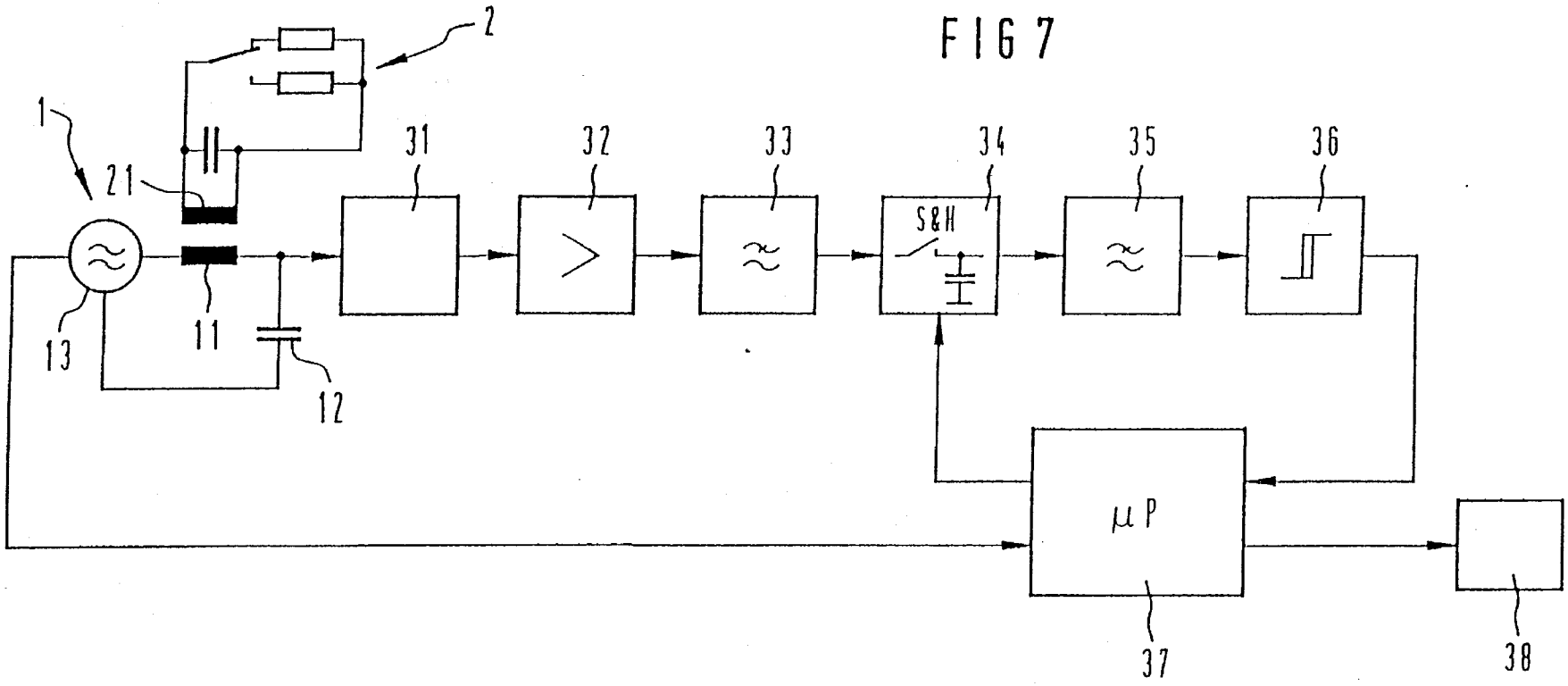
FIG. 7 is a schematic and block circuit diagram of the anti-theft system.

To that end, the evaluation unit 3 has a demodulator 31, which picks up the voltage between the transmitter coil 11 and the transmitter capacitor 12 and carries it, through an amplifier 32 and a low-pass filter 33, to a sample and hold element 34 that is not shown in FIG. 1 but is shown in FIG. 7.

The transponder 2 has an oscillating circuit which includes the transponder coil 21, a transponder capacitor 25 and the two load resistors 23 and 24. The load resistors 23 and 24 are switched into the transponder oscillating circuit in alternation in the rhythm of the code information through the load switch 22 by a non-illustrated code generator. As a result, the transmitter oscillating circuit is loaded in the rhythm of the code information. It is also possible for there to be a plurality of different load resistors.

The code information is stored in a non-illustrated memory of the transponder 2, for instance a ROM or an EEPROM. However, the code information may also be contained in the transponder 2 in hardware form. It does not matter for the invention how the code information is contained in the transponder 2 or how it is transmitted to the transmitter 1.

The transmitter oscillating circuit oscillates at the exciter frequency that is specified by the oscillator 13. When the ignition key is introduced into the ignition lock, the transmitter coil 11 and the transponder coil 21 are then located in the immediate vicinity of one another. Consequently, the two coils 11 and 21 are coupled inductively with one another, in such a way that the code information is transmitted to the transmitter oscillating circuit. In other words, the oscillation of the transmitter oscillating circuit is varied, as is illustrated in FIG. 2.

Since the transponder oscillating circuit is loaded in alternation with two different load resistors 23 and 24, the transmitter oscillating circuit is load-modulated, in synchronism with the switching back and forth between the load resistors 23 and 24.

Figure 2:
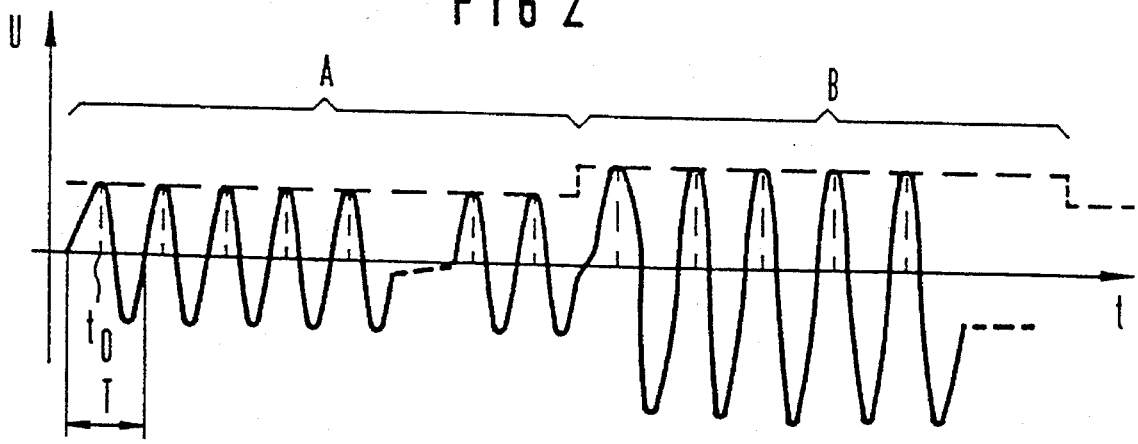
FIG. 2 is a diagram showing a modulated oscillation in a receiver of the anti-theft system.

The load modulation corresponds to an amplitude modulation as is shown in FIG. 2. The frequency of the oscillation does not vary because of the load. In a first segment A of the oscillation, the first load resistor 23 or 24 loads the transmitter oscillating circuit, and in a second segment B, the other load resistor 24 or 23, as applicable, loads the transmitter oscillating circuit.

Accordingly, a segment includes a plurality of periods, each with identical successive courses of oscillation, each of the same period length T and the same amplitude. After each segment A or B, the amplitude and phase of the oscillation change. In order to represent the entire oscillation, an oscillation A during a period within the segment A and an oscillation B during a period within the segment B will be observed below.

The code information of the transponder 2 is contained in an envelope curve of the modulated oscillation on the transmitter side. The envelope curve is represented in FIG. 2 by a dashed line. The evaluation unit 3 filters this code information out of the modulated oscillation. In other words, the amplitudes of the modulated oscillation are measured and evaluated.

Referring again to FIG. 7, the code information is digitized and compared in a digital arithmetic unit 37 with command code information stored in memory. If both items of code information match, an enable signal is sent to a security unit 38, which generates a control signal.

A course over time of sinusoidal variables illustrated in FIG. 3*b* is typically shown in a coordinate system, in which a time t or a circuit frequency wt are plotted on the X axis, and an amplitude is plotted on the Y axis. An instantaneous value of a sinusoidal voltage u or of a current i is unequivocally determined by two variables, that is by an amplitude $\hat{u}$ and a phase $\phi$ at a certain frequency f. In order to illustrate such variables, they are typically shown in a pointer diagram in the complex plane as in FIG. 3*a*. A real portion Re is plotted on the X axis, and an imaginary portion Im is plotted on the Y axis. The instantaneous value is then represented as a complex pointer $\underline{u}$ or $\underline{i}$, of a certain length and a certain phase $\phi$. The underlining in the reference symbols $\underline{u}$ or $\underline{i}$ indicates the complex variable.

In the example of FIGS. 3*a* and 3*b*, the voltage u is phase-shifted from the current i by the phase angle $\phi$. The instantaneous values, that is the real and imaginary portions at a time $\omega t=0$, can be read from the respective axis as projections or calculated as follows:

In the case of the real portion:

$$\mathrm{Re}\{\underline{u}\}=\hat{u}*\cos \omega t,$$

where $Re\{\underline{u}\}=\hat{u}$ at $\omega t=0$.

In the case of the imaginary portion:

$$Im\{\underline{u}\}=\hat{u}*\sin \omega t,$$

where $Im\{\underline{u}\}=0$ at $\omega t=0$; with $\hat{u}$=the maximum amplitude and $\omega t$=the circuit frequency of the oscillation.

In FIG. 4, the modulated oscillation in the segments A and B is shown, in each case during one period length T seen in FIG. 2. The oscillation A is brought about as a consequence of the loading by the first load resistor 23 or 24, and the oscillation B is brought about as a consequence of the loading by the second load resistor 24 or 23, respectively. The two oscillations A and B in actuality do not occur simultaneously but rather are located in chronologically successive segments, as is shown in FIG. 2. For the sake of clarity in the drawing, the oscillations A and B are shown one above the other in FIG. 4. The two oscillations A and B differ in their amplitude and are phase-shifted from one another by the phase angle $\phi$.

In order to obtain the magnitude of the modulated oscillation and therefore the code information, the oscillation is sampled at two equidistant times as is seen in FIG. 2. Modulated oscillation can be sampled a plurality of times within one period or once within a plurality of periods.

Advantageously, the spacing between two sampling times is precisely equivalent to a period length of $2\pi$ or an integral multiple thereof (that is, $2\pi n$, where n=1, 2, 3, . . . ). The greatest accuracy is attained if the sampling time (also referred to as working point) is arranged in such a way that the oscillations A and B are sampled at a maximum point as much as possible, or in other words as is shown in FIG. 4, the sampling point is set to $t_0=\pi/2$ with respect to the reference point 0, because the oscillation A has its maximum point there. The sampling time is defined by suitable dimensioning of all of the components involved and is therefore subject to certain fluctuations, resulting from component tolerances or temperature changes.

If the modulated oscillation is always sampled at a constant time within the period, for instance at $t_0=90°$ ($=\pi/2$), then the maximum amplitude is obtained from the oscillation A seen in FIG. 4. Since the oscillation B is phase-shifted by the phase angle $\phi$, what is obtained at the time $t_0$ is not the maximum amplitude for it, but nevertheless a readily usable amplitude, which differs clearly from that of the oscillation A. The difference between the two amplitudes is evaluated for the code information.

As a result of component tolerances and temperature factors it can happen that on one hand the sampling time will shift or that on the other hand the phase angle $\phi$ between the oscillations A and B will become greater or smaller. If sampling were carried out at a time $t_1$, for instance, then at that point the two amplitudes would be the same. Therefore, the demodulator 31 does not detect any code information even though the modulated oscillation does contain code information.

If initially no code information can be obtained from the modulated oscillation, then according to the invention the modulated oscillation must be sampled at a sampling time that is phase-shifted from the first sampling time by a phase angle $\phi_1$. If it is assumed that at the time $t_0$ both amplitudes are of equal magnitude, then at the time t=0 sampling can, for instance, be carried out again. There the two amplitudes differ markedly from one another. In order to perform sampling at the time $t_1$, sampling would then have to be carried out again at the time $t_2$.

The phase angle $\phi_1=90°$ ($=\pi/2$) is a special case, in which the invention can be explained especially simply. This angle is precisely equivalent to the phase difference between the real and imaginary portions. The differences in the amplitudes at the two sampling times can therefore also be explained in terms of the difference between the two real portions $\Delta Re\{u\}$ and the difference between the two imaginary portions $\Delta Im\{u\}$:

$$\Delta Re\{u\}=u_A(\omega t+2\pi(n+1/4))-u_B(\omega t+2\pi(n+1/4))$$

$$\Delta Im\{u\}=u_A(\omega t+2\pi n)-u_B(\omega t+2\pi n))$$

where n=0, 1, 2, 3, . . . (number of periods in the oscillation).

At the time t=0 and within the first period (n=0), the following values are obtained for the differences between the real and imaginary portions:

$$\Delta Re\{u\}=u_A(\pi/2)-u_B(\pi/2),$$

that is the amplitude difference at the time $t=90°=\pi/2$.

$$\Delta Im\{u\}=u_A(0)-u_B(0),$$

that is the amplitude difference at the time t=0°.

If the differences between the real portions and between the imaginary portions are added together quantitatively, the result obtained from this is the code information.

Figure 5A:
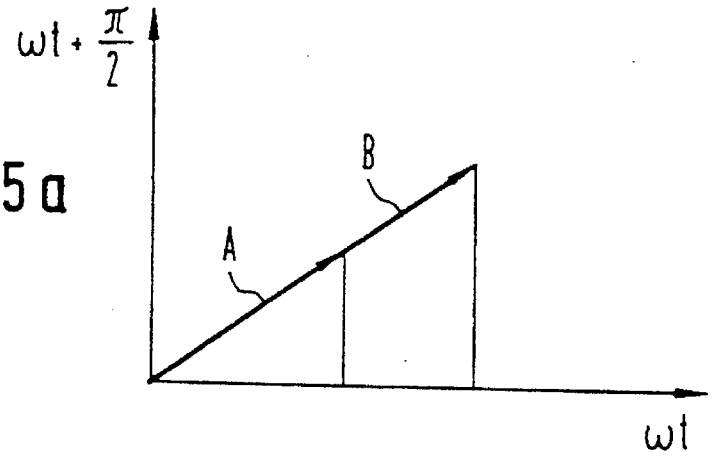
FIGS. 5*a*, 5*b* and 6 are pointer diagrams at predetermined times of the modulated oscillation.
Figure 5B:
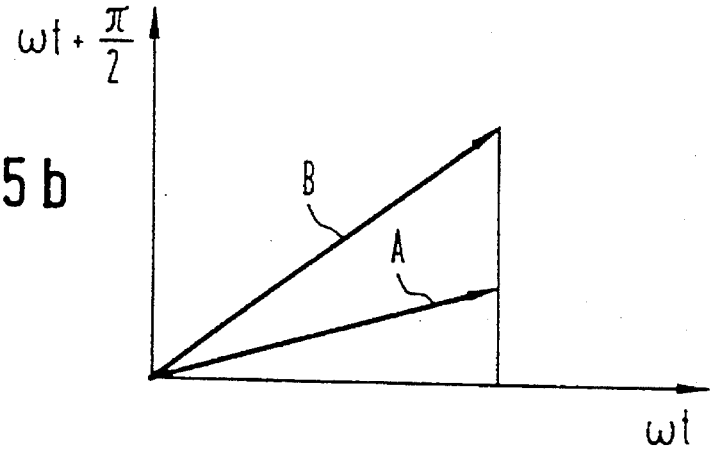

In FIG. 5*a*, two pointers are shown, specifically the pointers of the real portion of the two oscillations A and B, at a sampling time. As a rule, the length of the pointers differs by a certain amount, that is the real portions differ from one another, and it is possible to obtain code information. However, if the special case occurs in which the real portions are identical (FIG. 5*b*), then the code information cannot be obtained, since despite the modulated oscillation no difference is recognized in the amplitudes. This can be due to component tolerances or the influence of temperature, because the anti-theft system is dimensioned by the manufacturer in such a way that under normal conditions, code information is always obtained the first time that the modulated oscillation is sampled.

If nevertheless both real portions are of equal magnitude, then the system has its operating point at a so-called zero point, which depends on component tolerances or temperature factors but which is undesirable in any event. This is because, even with a correctly functioning transponder 2, it is not possible to tell whether the transponder 2 is authorized, since no code information is detected.

Figure 6:
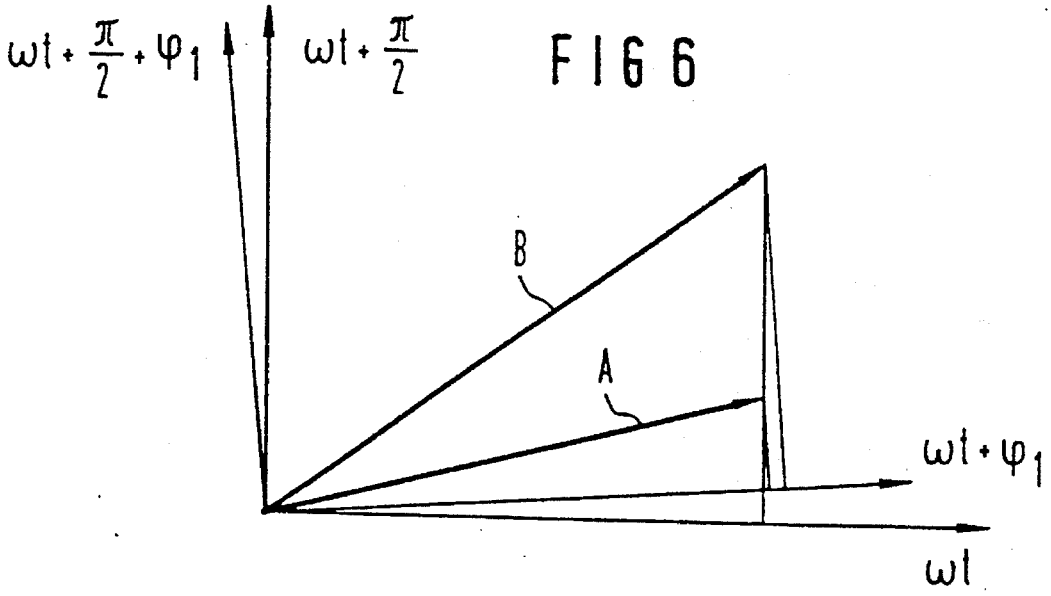

In such a case, according to the invention the modulated oscillation is sampled once again, specifically phase-shifted by a phase angle $\phi_1$. This re-sampling is shown in FIG. 6 and is equivalent to a rotation of the coordinate system about the phase angle $\phi_1$. It is clear from FIG. 6 that in the sampling phase shifted by the phase angle $\phi_1$, a difference between the two amplitudes is detected, and the code information can be obtained from the modulated oscillation.

The phase angle $\phi_1$ by which the second sampling time is shifted relative to the first sampling time should be markedly greater than 0° and markedly less than 360°. In other words, it should be between 0° and 360° ($=2\pi$). In an advantageous special case, $\phi_1=90°$ ($=\pi/2$). The double sampling is equivalent to breaking the modulated oscillation down into its real portion and its imaginary portion at a certain time.

FIG. 7 is a block circuit diagram of the anti-theft system of the invention. The oscillator 13 with its oscillator oscillation compels an oscillation of the same frequency in the transmitter oscillating circuit, which is load-modulated as a consequence of the approach of the transponder 2 to the transmitter oscillating circuit. The modulated signal is carried through the demodulator 31, the amplifier 32 and the low-pass filter 33 to the sample and hold element 34, where the value of the signal at the specified time $t_0$ is measured and held for a short time. In a further low-pass filter 35, the sampled signal is smoothed and sent to a Schmitt trigger 36, which converts the smoothed signal into a rectangular signal for the arithmetic unit 37.

The oscillating oscillation is also supplied to the arithmetic unit 37 in the form of a reference or synchronization signal. The sample and hold element 37 can thus be triggered in synchronism with the exciter oscillation by the arithmetic unit 37. The result is a fixed reference point, to which all of the sampling times are referred. This also assures that the modulated oscillation will always be sampled at the same time within each period.

First, the modulated signal is sampled at a specified time, for instance at $t_0$. If a difference in amplitudes is already noted at this time, then evaluatable code information is available. This code information is then compared with command or set-point code information that has been stored by the manufacturer in a memory of the arithmetic unit 37. If the two code signals match, the transponder 2 is authorized to unlock doors or to release the driveaway interlock. An enable signal is thereupon generated and sent to the security unit 38.

If at first no code information is obtained, then the modulated signal is again sampled at a further, predetermined time, and this sampling time is shifted by the phase angle $\phi_1$. The re-sampled signal is then processed in the same way as the signal sampled first. After that, code information is available in every case.

Since the oscillator oscillation is also supplied to the arithmetic unit 37, the sampling times are always at well-defined points within one period.

Figure 8:
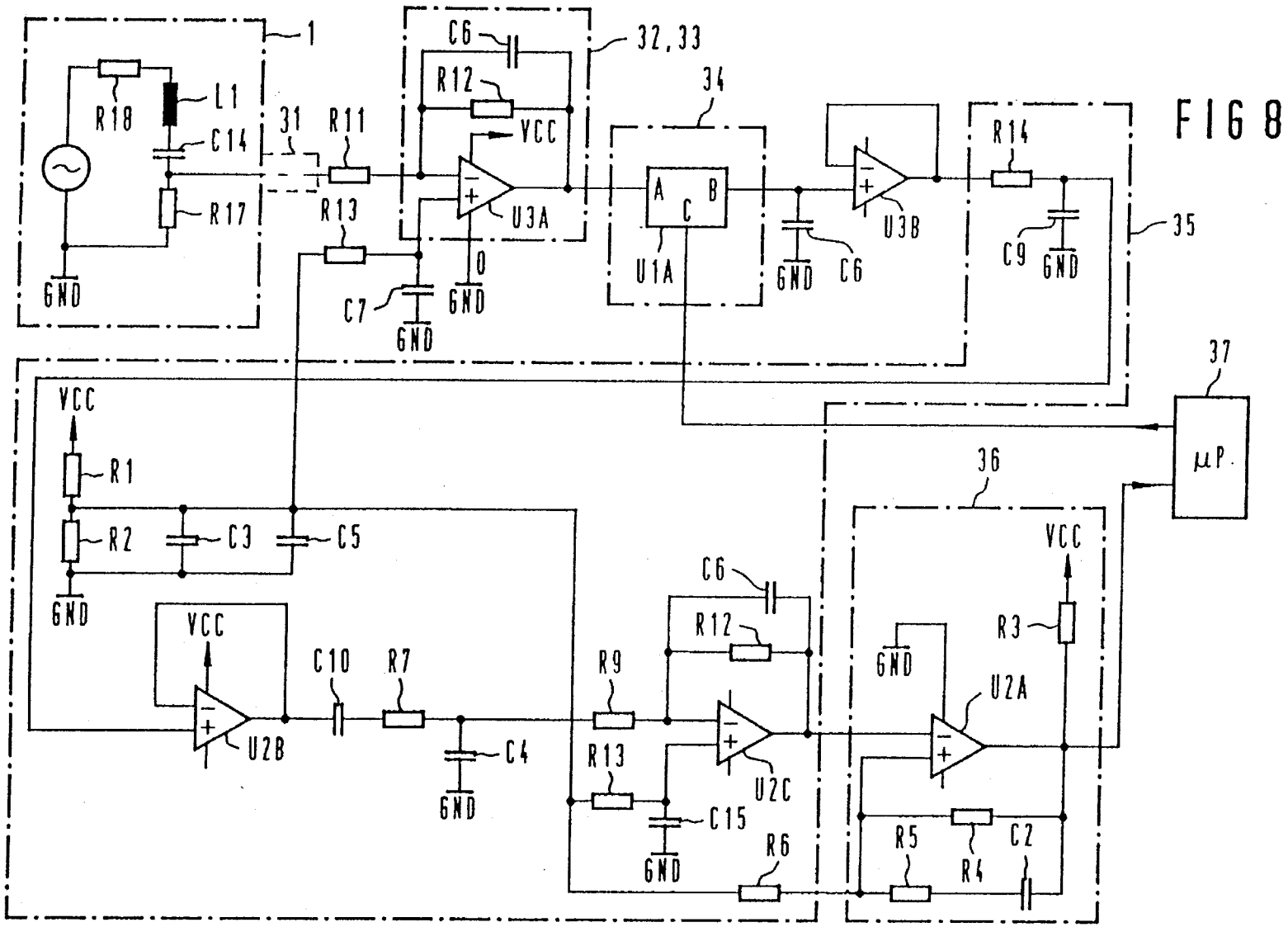
FIG. 8 is a schematic and block circuit diagram of the anti-theft system.

In FIG. 8, an exemplary embodiment of a circuit configuration for the anti-theft system of the invention is shown. The components from the block diagram of FIG. 7 are shown in dashed lines in FIG. 8.

In FIG. 8, a block 7, shown in dashed lines, correspond to the transmitter 7 in FIG. 7, and a block 31 corresponds to the demodulator 31 in FIG. 7. A block 32, 33 also corresponds to amplifier 32 and the low-pass filter 33 of FIG. 7, wherein an operational amplifier U3A is configured as an active low-pass filter having a feed-back loop composed of a capacitor C6 in parallel with a resistor R12. A negative input pin 2 of the operational amplifier receives the demodulated signal from the demodulator 31, and its positive input pin 3 receives a bias potential from a resistor-capacitor network, R1, R2 and C3, C5 connected to a bias resistor R13, which is decoupled to ground by a capacitor C7. An output pin 1 of the operational amplifier U3A is connected to a sample and hold element 34, which is a sample-and-hold circuit U1A having an input A connected to the output pin 1 of the operational amplifier U3A. The sample-and-hold circuit is controlled at an input C by a sampling control signal delivered by the microprocessor 37. An output of the sample-and-hold circuit 34 is connected to an input of an operational amplifier U3B, which is coupled as a unity-gain amplifier, having an output 7 connected through an RC network R14, C9, that provides low-pass emphasis to the positive input of an operational amplifier U2B, that also operates as a unity gain amplifier, presenting a high input impedance to the RC network R14, C9. An output of the operational amplifier U2B is connected through a frequency-correcting RC network C19, R7, C4 through a series resistor R9 to a negative input of an operational amplifier U2C, having a negative feedback loop formed of a parallel-connected resistor R8 and a capacitor C11, making the operational amplifier stage U3C operate as an active second low-pass filter stage. The operational amplifier U3C receives a bias potential at its positive input from the voltage divider R1, R2, which is decoupled to ground by a resistor R16 and a capacitor C15.

The output of the operational amplifier U3C is connected to a negative input of an operational amplifier U2A that is coupled as a Schmitt-trigger, due to a feed-back network composed of resistors R4, R5 and a capacitor C2 connected from an output of the operational amplifier U2A to its positive input. The output of the operational amplifier U2A is connected to a central input of the microprocessor 37.

The modulated oscillation can also be sampled in such a way that at least two voltage values are detected within each period of the oscillations A and B. However, the sampling times must be phase offset from one another by the phase angle $\phi_1$. These voltage values can be carried to the arithmetic unit 37 and evaluated there. If no code information can be obtained from the first voltage value, then recourse is made to the next voltage value.

It is equally possible to sample the modulated oscillation in such a way that at least one first voltage value is detected within a first period at the time $t_0$, and a second voltage value is detected in one of the periods following it of the modulated oscillation, but phase-shifted by the phase angle $\phi_1$ within this period with respect to the time $t_0$. These voltage values are then carried to the arithmetic unit 37 and evaluated there.

The oscillating circuit in the present exemplary embodiment is excited at a frequency f=125 kHz. This is equivalent to a period T=8 μs (≡2 π). A phase shift $\phi=\pi/2$ (≡90°) is accordingly equivalent to a time displacement of 2 μs.

The arithmetic unit 37 may be constructed as a microprocessor or as some functionally equivalent unit.

The security unit may be a central locking system or a portion of a driveaway interlock. The term driveaway interlock should be understood to mean electronic units in the motor vehicle of the kind that allow the engine to be started only when an authorized enable signal is received. The engine control unit, for instance or an on/off valve in the fuel line, or a switch in the ignition circuit, may be referred to as a security unit in this sense.

We claim:

1. An anti-theft system for a motor vehicle, comprising:

a portable transponder carrying code information;

a stationary transceiver having an oscillator and an oscillating circuit being excited to oscillate by said oscillator at an oscillation being modulated by said transponder in synchronism with the code information;

a demodulator connected to said transceiver for demodulating the modulated oscillation of said oscillating circuit;

a sampling device connected to said demodulator for sampling the oscillation at least at one predetermined sampling time to obtain the code information from the demodulated oscillation;

an arithmetic unit connected to said transceiver and to said sampling device for comparing the code information with command code information and issuing an enable signal if a match occurs; and a security unit connected to said arithmetic unit for receiving the enable signal;

said sampling device once again sampling the modulated oscillation being at a second predetermined sampling time which is shifted by a predetermined phase angle, if initially no code information is recognized from said demodulator.

2. The anti-theft system according to claim 1, wherein said predetermined phase angle is 90°.

3. The anti-theft system according to claim 2, wherein said oscillating circuit has a transmitter coil, and including a transponder coil inductively coupling said transponder to said transmitter coil.

4. The anti-theft system according to claim 3, wherein the oscillation of said oscillating circuit is load-modulated as a function of the code information due to said inductive coupling.

5. The anti-theft system according to claim 4, wherein said security unit is a door lock.

6. The anti-theft system according to claim 4, wherein said security unit is a driveaway interlock.

7. An anti-theft system for a motor vehicle, comprising:

a portable transponder carrying code information;

a stationary transceiver having an oscillator and an oscillating circuit being excited to oscillate by said oscillator at an oscillation being modulated by said transponder in synchronism with the code information;

a demodulator connected to said transceiver for demodulating the modulated oscillation of said oscillating circuit;

a sampling device connected to said demodulator for sampling the modulated oscillation containing the code information at least at two predetermined times being phase-shifted from one another by a predetermined phase angle and obtaining the code information from voltage values detected at the sampling times;

an arithmetic unit connected to said transceiver and to said sampling device for comparing the code information with command code information and issuing an enable signal if a match occurs; and a security unit receiving the enable signal.

* * * * *